US009988584B2

(12) United States Patent
Oehr

(10) Patent No.: US 9,988,584 B2
(45) Date of Patent: Jun. 5, 2018

(54) METHOD OF UPGRADING HEAVY CRUDE OIL

(71) Applicants: Rival Technologies Inc., Henderson, NV (US); George Alexander Constable, Vancouver (CA); Klaus H Oehr, Surrey (CA)

(72) Inventor: Klaus H Oehr, Surrey (CA)

(73) Assignee: RIVAL TECHNOLOGIES INC., Vancouver (CA)

( * ) Notice: Subject to any disclaimer, the term of this patent is extended or adjusted under 35 U.S.C. 154(b) by 137 days.

(21) Appl. No.: 14/766,891

(22) PCT Filed: Aug. 9, 2013

(86) PCT No.: PCT/CA2013/050617

§ 371 (c)(1),
(2) Date: Aug. 10, 2015

(87) PCT Pub. No.: WO2014/124517

PCT Pub. Date: Aug. 21, 2014

(65) Prior Publication Data

US 2016/0010004 A1 Jan. 14, 2016

(51) Int. Cl.
*C10G 55/04* (2006.01)
*C10G 9/00* (2006.01)
(Continued)

(52) U.S. Cl.
CPC ..... *C10G 55/04* (2013.01); *C10G 1/00* (2013.01); *C10G 7/00* (2013.01); *C10G 9/00* (2013.01);
(Continued)

(58) Field of Classification Search
CPC . C10G 55/04; C10G 1/00; C10G 7/00; C10G 21/16; C10G 9/00; C10G 2300/1033
See application file for complete search history.

(56) References Cited

U.S. PATENT DOCUMENTS 1,652,166 A 12/1927 Dubbs
1,924,848 A 8/1933 Egloff
(Continued)

FOREIGN PATENT DOCUMENTS

CA 2158765 3/2004
CA 2764676 8/2012
(Continued)

OTHER PUBLICATIONS

G.C. Laredo et al., "Naphthenic acids, total acid number and sulfur content profile characterization in Isthmus and Maya crude oils," Fuel 83 (2004) 1689-1695.
(Continued)

*Primary Examiner* — Randy Boyer
*Assistant Examiner* — Juan C Valencia
(74) *Attorney, Agent, or Firm* — Nyemaster Goode, P.C.

(57) ABSTRACT

A method of upgrading a heavy crude oil (10) by thermally cracking (12) the heavy crude oil in a cracking vessel to convert a portion to volatile components (14) while simultaneously venting the volatile components from the cracking vessel. Tetrathydrofurfuryl alcohol is optionally added to the heavy crude oil feedstock before or during cracking. The vented volatile components are separated (16) into condensable volatile components (18) and non-condensable volatile components (20). The condensable components are collected and comprise cracked-distilled oil. The cracking residue (48) is removed from the cracking vessel and a cracking residue extract is prepared and mixed with the cracked-distilled oil to produce synthetic crude oil.

29 Claims, 6 Drawing Sheets

(51) Int. Cl.

| | |
|---|---|
| ***C10G 21/16*** | (2006.01) |
| ***C10G 1/00*** | (2006.01) |
| ***C10G 7/00*** | (2006.01) |

(52) U.S. Cl.
CPC ..... *C10G 21/16* (2013.01); *C10G 2300/1033* (2013.01)

(56) References Cited

U.S. PATENT DOCUMENTS

| | | | | |
|---|---|---|---|---|
| 2,368,704 | A | 2/1945 | Carlson | |
| 3,579,601 | A | 5/1971 | Kivlen | |
| 4,399,025 | A | 8/1983 | Fletcher et al. | |
| 4,428,824 | A | 1/1984 | Choi et al. | |
| 4,454,023 | A | 6/1984 | Lutz | |
| 4,877,513 | A * | 10/1989 | Haire | C10G 9/007 208/106 |
| 5,795,464 | A | 8/1998 | Sankey et al. | |
| 5,976,360 | A | 11/1999 | Blum et al. | |
| 6,086,751 | A | 7/2000 | Bienstock et al. | |
| 7,976,695 | B2 | 7/2011 | Brecher | |
| 9,200,211 | B2 | 12/2015 | Corscadden et al. | |
| 2002/0025565 | A1 * | 2/2002 | Uhm | C12P 17/04 435/107 |
| 2010/0270208 | A1 * | 10/2010 | Ward | B01D 3/143 208/97 |
| 2012/0125811 | A1 * | 5/2012 | Bridges | C10G 9/005 208/50 |
| 2013/0180888 | A1 * | 7/2013 | Corscadden | C10G 21/003 208/309 |

FOREIGN PATENT DOCUMENTS

| | | |
|---|---|---|
| WO | 2005113726 | 12/2005 |
| WO | 2008124912 | 10/2008 |
| WO | WO 2008/124912 * | 10/2008 |

OTHER PUBLICATIONS

Omar Yepez, "On the chemical reaction between carboxylic acids and iron, including the special case of naphthenic acid," Fuel 86 (2007) 1162-1168.
Omar Yepez, "Influence of different sulfur compounds on corrosion due to naphthenic acid," Fuel 84 (2005) 97-104.
Serge Raseev, "Thermal and Catalytic Processes in Petroleum Refining," Marcel Dekker, Inc., 2003, pp. 70-72.
Craig A. Gelfound of Arent Fox LLP, Letter containing claim chart, dated Oct. 18, 2017, 3 pages.
Craig A. Gelfound of Arent Fox LLP, Letter containing claim chart, dated Nov. 9, 2017, 4 pages.
R. George S. Ritchie et al., A Pyrolysis-Gas Chrornatographic Analysis of Athabasca Bitumen, American Chemical Society, 1978, 3 pages, vol. 17, No. 4.
Al Wiedmann Jr. of Santangelo Law Offices, P.C., Letter containing prior art references and claim chart, dated Oct. 31, 2017, 8 pages.
Craig A. Gelfound of Arent Fox LLP, Letter containing claim chart, dated Dec. 15, 2017, 5 pages.
Penn A Kem LLC, THFA Material Safely Data Sheet, dated Apr. 9, 2013, 4 pages.
Invensys, THFA Phase Envelope, dated 1994-2014, 1 page.

* cited by examiner

METHOD OF UPGRADING HEAVY CRUDE OIL

FIELD OF THE INVENTION

The invention pertains to the upgrading of heavy hydrocarbons, especially heavy crude oil, including heavy oil containing high levels of sulphur.

BACKGROUND OF THE INVENTION

Crude oil contains many different chemical components. In general terms, it consists primarily of hydrocarbon compounds, with varying amounts of impurities such as metals, chlorine, sulphur, nitrogen, asphaltenes and coke. Heavy crude oil has a lower hydrogen-to-carbon ratio than lighter crude oil, so the density (or specific gravity) of heavy crude oil is greater than that of a lighter crude oil. High specific gravity and viscosity are properties of heavy oil that cause major production and handling problems.

Heavy oil is generally any crude oil with an API gravity ranging from about 11° to 20° at standard conditions and with a gas-free viscosity ranging from about 100 to 10,000 centipoises (cp) at original reservoir temperature. Ultra heavy oil, such as tar sand oil, also known as bitumen, is any crude oil with an API gravity less than about 11° and a gas-free viscosity greater than 10,000 cp. Pipeline-able oil such as synthetic crude oil typically requires an API gravity of 19° and a viscosity at room temperature below 350 cp.

A significant problem with heavy oil is the difficulty and expense entailed in increasing the volume of lighter hydrocarbons derived from a heavy oil feedstock. Typically, this is done by increasing the hydrogen-to-carbon ratio. This can be accomplished by either removing carbon or by adding hydrogen. Carbon is typically removed by coking, solvent de-asphalting, or catalytic cracking. Hydrogen is typically added by hydro-treating or hydrocracking.

Hydrocracking processes are known which utilize a catalyst in a hydrogen environment to convert heavy distillates into lighter distillates. Catalytic cracking processes further convert crude oils including synthetic crude oils to products such as gasoline or jet fuels. Such processes typically include adding to heavy oil feedstock or distillate a source of donor hydrogen such as hydrogen gas. Unfortunately, typical heavy oil feedstocks have relatively high metal content (100 parts per million or higher) and/or other impurities, including acids, chlorides and carbon residues (e.g. micro-carbon residues). The metals and other impurities limit the application of hydrocracking and hydro-treating in one or more ways: (a) the metals contaminate the catalyst; (b) the acids and chlorides corrode the hydrotreaters or catalytic crackers; and (c) the carbon residues foul either the catalysts or the equipment with carbon (coke).

Typical prior art heavy crude oil upgrading via sequential cracking and distillation is carried out in one of two ways: (1) pressurized or un-pressurized heavy crude oil cracking, without a non-condensable sweep gas, at elevated temperature with sequential venting and distillation of cracked heavy crude oil to separate cracked and un-cracked volatiles from cracked and un-cracked non-volatiles; and (2) pressurized or un-pressurized heavy crude oil cracking, with a non-condensable sweep gas, at elevated temperature with sequential venting and distillation of cracked heavy crude oil to separate cracked and un-cracked volatiles from cracked and un-cracked non-volatiles.

Pressurized or un-pressurized cracking at elevated temperature followed by sequential venting and distillation results in a) the undesirable formation of coke, at higher cracking temperatures and/or pressures, as widely seen in the prior art, or b) excessively long cracking times under conditions which minimize coke formation i.e. lower cracking temperatures.

There is substantial cracking prior art which describes undesirable coke formation in the absence of a sweep gas:

U.S. Pat. No. 4,428,824 (Choi et al.) describes cracking issues associated with feedstocks containing asphaltenes. It states, "Heretofore, visbreaking has only had a limited efficiency when processing charge stocks containing asphaltenes. In conventional visbreaking of such charge stocks a sediment in the form of coke is formed, which has the tendency to plug the visbreaker reactor, shorten production runs and result in unacceptably lengthy periods of down time", (col. 1, lines 35 to 41). U.S. Pat. No. 5,795,464 (Sankey et al.) describes the use of visbreaking, a thermal conversion process, widely practiced commercially as a means for obtaining low levels of conversion of heavy oils, including bitumen (col. 1, lines 47 to 50). It states that "the severity of visbreaking has generally been limited by coke formation which fouls the process equipment" and that typical maximum conversion levels for visbreaking bitumen is no more than about 30 to 35% of the 525° C.+ material i.e. heavy crude oil components having boiling points above 525° C. which still leaves the bitumen too viscous for pipelining without the use of expensive diluents to drop the viscosity to an acceptable range. The patent shows in Table 1 that an Athabasca bitumen under conventional visbreaking does not meet pipeline specifications for either API specific gravity or viscosity. Furthermore, content of nickel and vanadium, both of which are undesirable in oil refinery hydrotreating and catalytic cracker operations, were high at 300 ppm (i.e. unchanged from the original bitumen feed).

WO 2005/113726 (Varadaraj et al.) discloses that heating of bitumen to 399° C., equivalent to a short visbreaking run, resulted in fouling of the visbreaker with a carbonaceous deposit in the absence of a coking inhibitor. It states, [0019] 120 g of bitumen was rapidly heated under nitrogen[350 PSI (2413.17 kPa)] to 750° F. (398.89° C.) with continuous stirring at 1500 RPM. The bitumen was allowed to react under these conditions for a period of time calculated to be equivalent to a short visbreaking run at a temperature of 875° F. (468° C.) (typically 120 to 180 "equivalent seconds"). After achieving the desired visbreaking severity, the autoclave was rapidly cooled in order to stop any further thermal conversion. The inside of the autoclave was observed to be fouled with a carbonaceous deposit when the bitumen was thermally treated as described above."

The Varadaraj reference confirms that the "primary limitations in thermal treatment of heavy oils, such as visbreaking, are the formation of toluene insolubles (TI) at high process severities" (para. 0003, page 1). Asphaltenes and microcarbon content are virtually unchanged due to the non-visbreaking thermal treatment conditions. The process therefore would have no commercial viability in regions where long distance pipelining of heavy crude oil is the norm, such as Alberta, Canada.

The prior art describes attempts to minimize coke formation, pressurized or un-pressurized heavy crude oil cracking at elevated temperature with sequential venting, and distillation of cracked heavy crude oil to separate cracked and un-cracked volatiles from cracked and un-cracked non-volatiles in which extremely long cracking times are used.

Canadian patent application CA 2,764,676 (Corscadden et al.) describes sequential "mild controlled cracking" of heavy crude oil (page 15, lines 24-25) in which "After the mild cracking process, a light top fraction 32 (distillate containing condensable and non-condensable volatiles) can be routed from the reactor 30 to a gas liquid condensing separator process 40" (page 15, lines 25-26). Residence time is excessive at 40-180 minutes due to low cracking temperatures of 675-775° F. (357-412° C.) and pressures ≤5.50 psig. Excessive residence times result in excessive reactor sizes and equipment capital costs.

There is substantial cracking prior art which describes the use of sweep gas in combination with cracking:

CA 2,764,676 (Corscadden et al.) describes the use of 20-80 standard cubic feet (scf) of sweep gas per barrel of heavy crude oil during cracking at cracking temperatures of (675-775° F.) (357-413° C.) (page 18, lines 14 to 16). For a 10,000 barrel/day cracker the volume of gas at room temperature and atmospheric pressure in liters for a 40-minute minimum cracker residence time is given by: 10000/24*40/60*20*28.3168=157,315 liters minimum up to 629,262 liters maximum. Liters of HCO processed in a 40-minute residence time is given by: 10000/24*40/60*159=44,166 liters. This is a massive amount of gas that must be heated from room temperature to cracker temperature to prevent cracker cooling by sweep gas. So, heating this amount of sweep gas from room temperature to cracker temperature while maintaining cracker pressure increases the volume of sweep gas in the reactor by the ratio of temperatures in ° K (i.e. 686/293 or 2.34 for 413/20 ratio in ° C.) or 368,321 to 1,473,289 liters of sweep gas/cracker residence time of 40 minutes and heavy crude oil volume of 44,166 liters. This is a large amount of sweep gas, relative to the minimum cracker volume at minimum cracker residence time, especially if the gas is natural gas or hydrogen i.e. 368,321/44,166=8.34 to 1,473,289/44,166=33.4 (see page 18, line 17). Furthermore, this large volume of hot non-condensable sweep gas must be subsequently cooled so that intermixed condensable cracked heavy crude oil distillate can be condensed. This has a substantial negative impact on the operating cost of the condenser/distillation apparatus.

U.S. Pat. No. 6,086,751 (Bienstock et al.) describes a process for upgrading heavy crude oil (Venezuelan heavy crudes and bitumen) via reduction of total acid number (TAN) and viscosity. However, it states that, "The thermal treatment of this invention is not to be confused with visbreaking which is essentially a treatment of heavy oils or whole crudes at temperatures in excess of the temperatures of the thermal treatment disclosed herein" and that "The thermal treatment process of this invention is designed to minimize cracking of hydrocarbons" (col. 1, lines 41-44; and col. 3, lines 37 to 38). It requires the use of inert gas to reduce the partial pressure of water in a heavy crude oil upgrader reaction zone to maximize TAN reduction. The reaction zone must be purged with inert gas (e.g. methane) to control partial pressure, and the purge rate will generally fall in the range of 50-500 standard cubic feet per barrel (see col. 3, lines 27 to 34). It shows the use of argon as purge gas in Example 1 at 380 standard cubic feet per barrel of bitumen (col. 5, lines 48 to 49). The invention of Bienstock et al. suffers from the following disadvantages: (1) API gravity is not increased, (i.e. this technique would not produce pipeline-able heavy crude oil) and therefore requires the addition of large amounts of expensive high API condensate or sweet synthetic crude oil. (2) The metals content is not improved and remains high at 400+ ppm nickel and vanadium. (3) Purge gas requirements are very high and costly (argon purge gas is very expensive).

The prior art describes the use of tetrahydrofurfuryl alcohol (THFA) in upgrading heavy crude oil. U.S. Pat. No. 4,877,513 (Haire et al.) discloses the addition of small amounts of THFA or other alcohols to heavy oil (i.e. 1-3 weight % THFA) followed by heating at elevated temperature (e.g. up to 399° C.) in the presence of iron-containing surfaces or particles for periods of between 600 to 6000 seconds, to reduce the viscosity and specific gravity of the heavy oil. The patent states: "The process of the present invention increases the volume of light hydrocarbons distilled from a heavy oil feedstock at a selected temperature. The process of the present invention operates at low pressures (near atmospheric pressure), without an external hydrogen gas supply, and without being dependent upon a solvent extraction process. Moreover, the present invention utilizes an active reagent which is less than 3% by weight of the heavy oil feedstock." (column 3, lines 14 to 23). Although the process of U.S. Pat. No. 4,877,513 results in a reduction of specific gravity and viscosity, it suffers from certain drawbacks which render it commercially nonviable:

- the lack of a solvent extraction process to eliminate or reduce asphaltene sludge and coke, resulting in a high undesirable asphaltene or coke content and a product that is highly likely to cause unacceptable fouling of pipelines even though it may have acceptable viscosity;
- low yield of sequentially distillable hydrocarbons with a boiling point at or below 525° C. (i.e. high yield of distillation residue);
- the reactor is highly susceptible to "spray flow regime issues" (i.e. extreme gas formation during heavy crude oil cracking, such as the gas volumes of 59 to 213 liters for only 257 grams of heavy crude oil feed in tests 1 and 6 in Table 1);
- no technique is described for recycling the alcohol additive in whole or in part;
- without subsequent (sequential) distillation, the product is highly contaminated with heavy metals, and actually concentrates contained heavy metals, making it extremely difficult to hydro-treat to further reduce viscosity and/or sulphur content;
- the process requires a tubular reactor, the inner walls of which must include ferrous metal with excessive reaction times e.g. 83 min for THFA in Table 1;
- liquid product yields are very low ahead of distillation (e.g. 63.0% by weight, or 160 grams output per 254 grams input in Test 4, Table 1, indicating that 37% by weight of the heavy crude oil feedstock is converted to gases, asphaltene sludge or coke);
- conversion level for 525° C.+ material (i.e. heavy crude oil components having boiling points above 525° C.) is extremely low at only 16% (see Table 4);
- the tubular reactor (plug flow) or its iron powder or rod inserts is highly susceptible to iron corrosion for steel and iron/nickel corrosion for stainless steel at its inlet, where heavy crude oil total acidity (TAN) is at a maximum and hydrogen sulphide content of the gas phase (i.e. corrosion inhibitor) is at a minimum; for example, see: Laredo et al. "Naphthenic Acids, Total Acid Number and Sulfur Content Profile in Isthmus and Maya Crude Oils", Fuel 83 (2004) pages 1689-1695; O. Yépez, "On the Chemical Reactions between Carboxylic Acids and Iron, Including the Special Case of Naphthenic Acids", Fuel 86 (2007) pages 1162-1168; and O. Yépez, "Influence of Different Sulfur Compounds on Corrosion due to Naphthenic Acid", Fuel 84 (2005), pages 97-104).

The tubular reactor (plug flow) or its iron powder or rod inserts is highly susceptible to coking. This is confirmed by S. Raseev, in "Thermal and Catalytic Processes in Petroleum Refining", Marcel Dekker (2003) at pages 70-71, which states: "Detailed studies using electron microscopy and X-Ray dispersion revealed that formation of coke in the furnace tubes is a stage-wise process. In the first stage, coke filaments are formed due to reactions on the metal surface catalyzed by iron and nickel. Once the coke filaments have appeared, coke formation is amplified in subsequent stages. The reduction of the catalytic effect of iron and nickel is accomplished in two ways. The second method used in industry consists of introducing into the feed, after decoking, hydrogen sulphide."

Haire et al., U.S. Pat. No. 4,877,513, actually recommends the use of excess iron and does not suggest a need to prevent iron corrosion (i.e. formation of corroded "ionic iron"). It states: "The metallic exposure can occur by a variety of methods including without limitation heating the mixture in a metallic reactor vessel having inner walls containing ferrous metal, or adding ferrous metal particles to the mixture, or placing ferrous or steel rods in the reactor vessel, for example. It should be appreciated that use of ferrous metal particles may affect subsequent refining steps. "(col. 4, lines 56-63)." It further states: "The inventors have postulated a probable mechanism for the present invention involving an ionic iron complex. The restructuring of the hydrocarbons apparently involves a surface reaction among the reagent(s), the ferrous metal and the heavier hydrocarbons (so-called polysegmented hydrocarbons)." (col. 12, lines 58-63).

The prior art ignores the negative impact of pressure with respect to over-cracking potentially resulting in undesirable coke formation even at pressures deemed acceptable (e.g. 50 psig as in CA 2,764,676, page 18, line 9). Increasing cracker pressure from atmospheric pressure (i.e. 14.7 psig or 760 mm mercury) to, for example, 50 psig (2550 mm mercury) increases the boiling point of cracker condensable volatiles by approximately 69 to 75° C. for typical cracker components including non-cyclic alkanes, cyclic alkanes (naphthenes), aromatics and mercaptans (thiols). This can be shown by use of the Antoine equation (e.g. http://en.wikipedia.org/wiki/Antoine_equation and Wilhoit et al, 1971. "Handbook of Vapor Pressures and Heats of Vaporization of Hydrocarbons and Related Compounds". Publication 101, The American Petroleum Institute). The following Table 1 shows the effect of pressure on the boiling point of typical cracked and un-cracked heavy crude oil components as calculated from the above Wilhoit et al. reference. Strausz et al. 2003. "The Chemistry of Alberta Oil Sands, Bitumens and Heavy Oils. Alberta Energy Research Institute verifies the presence of these and similar compounds in heavy crude oil. Several boiling points, shown in ° C., are above the maximum cracker temperature of 413° C. proposed in CA 2,764,676, supra.

TABLE 1

| Compound | Boiling point at atmospheric pressure (760 mm mercury) | Boiling point at 50 psig (2550 mm mercury) | Increase in boiling point |
|---|---|---|---|
| anthracene | 341 | 415 | 74 |
| phenanthrene | 339 | 414 | 75 |
| 1-heptadecanethiol | 348 | 418 | 70 |
| n-pentadecylcyclopentane | 352 | 421 | 69 |
| n-tetradecylcyclohexane | 355 | 426 | 71 |
| 9,10-dithiooctadecane | 346 | 417 | 71 |
| n-hexadecylcyclopentane | 364 | 434 | 70 |

TABLE 1-continued

| Compound | Boiling point at atmospheric pressure (760 mm mercury) | Boiling point at 50 psig (2550 mm mercury) | Increase in boiling point |
|---|---|---|---|
| n-hexadeclcyclohexane | 379 | 451 | 72 |
| 1-eicosanethiol | 383 | 455 | 72 |
| 11,12-dithiodocosane | 390 | 464 | 74 |

Increasing the boiling point of cracked and un-cracked heavy crude oil components, especially alkanes and thiols, to temperatures above the cracker operating temperature will cause them to over-crack resulting in unnecessary hydrogen free radical consumption which would otherwise be available for asphaltene free radical quenching to prevent undesirable coke formation.

Accordingly, there exists a need for an improved means of upgrading heavy hydrocarbons, including heavy crude oils, providing one or more of the following desirable features: scalability; portability; simplified processing; elimination or reduction of heavy metals, acids, chlorides, nitrogen, asphaltenes, micro-carbon residue (MCR) and coke; reduction of sulfur content; greater than 35% conversion of 525+° C. boiling point component of heavy crude oil feedstock without excessive coke formation; reduction of viscosity and TAN without the need for expensive purge or sweep gas; elimination of the need for purge gas or sweep gas; reduced operating pressure; elimination of the need for sequential cracking and distillation/condensation of condensable and non-condensable cracked and un-cracked heavy crude oil components; faster cracking with little or no coke (i.e. toluene insolubles) formation; and faster use of THFA, including THFA recycling, with better THFA product properties.

SUMMARY OF THE INVENTION

According to one aspect of the invention, there is provided a method of upgrading a heavy crude oil, comprising the steps of thermally cracking the heavy crude oil in a cracking vessel to convert a portion of the heavy crude oil to volatile components while simultaneously venting the volatile components from the cracking vessel, separating the vented volatile components into condensable and non-condensable volatile components, and collecting the condensable volatile components, said components comprising cracked-distilled oil. According to some aspects of the invention, the method includes mixing THFA with the heavy crude oil prior to or during the thermal cracking. According to other aspects of the invention, the process includes removing a cracking residue from the cracking vessel, producing a cracking residue extract and mixing the cracking residue extract with the cracked-distilled oil to produce a synthetic crude oil.

According to another aspect of the invention, there is provided an apparatus for upgrading heavy crude oil, comprising a thermal cracking vessel for performing thermal cracking of the heavy crude oil, means for venting volatile components from the thermal cracking vessel simultaneously with the thermal cracking, and means for separating the vented volatile components into condensable and non-condensable volatile components.

In the present invention volatile components generated during thermal cracking, including volatile components such as hydrogen sulfide, low molecular weight olefins (e.g. ethylene or propylene) and ultralow molecular weight alkanes such as methane, ethane or propane, are vented as soon as they are generated, i.e. simultaneously to cracking of the heavy crude oil feedstock, without the need for a sweep or purge gas (e.g. via a water-cooled condenser).

It is believed that one advantage of the invention is that it does not over-crack molecules in the heavy crude oil (e.g. alkanes), by allowing them to leave the cracker as soon as they are able. Conventional pressurized vis-breaking, by preventing the escape of volatile products, turns valuable liquid vis-breaking products into less valuable gases by over-cracking. The present invention cracks non-volatile elements while the volatile elements are permitted to leave the cracking vessel and enter the distillation column.

The cracking may take place in a cracking vessel or a combined cracking-distillation vessel. The cracking and distilling steps may take place simultaneously or sequentially although venting of cracker condensables and non-condensables is carried out as simultaneously as possible. The majority of vented alkanes are condensed to become a valuable component of the resulting synthetic crude oil.

Venting of the volatile components during cracking reduces or eliminates undesirable coke formation and increases heavy crude oil conversion. Portions of vented volatile components, including any evaporated or partially evaporated THFA, can be captured for separate uses, for example, THFA recycling to the cracking vessel.

The THFA used in the present invention is recyclable, in whole or in part. In addition, the synthetic crude oil yields, synthetic crude oil distillables, and heavy crude oil 525+° C. boiling point component conversions of the present invention are high as compared to conventional pressurized visbreaking. With THFA addition in the current invention all of these advantages are achieved with an insignificant amount of coke formation (i.e. toluene insolubles) even at very high heavy crude oil conversions to synthetic crude oil.

Further aspects of the invention and features of specific embodiments are described below.

DETAILED DESCRIPTION

Figure 1:
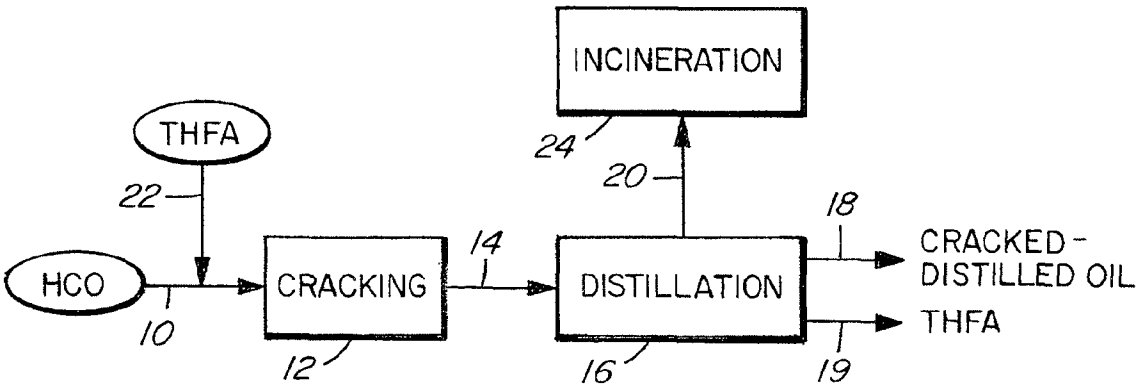
FIG. 1 is a schematic diagram of one embodiment of the method and apparatus of the invention, in which THFA additive is used.

In the following description of some exemplary embodiments of the invention and in the drawings, corresponding and like elements are identified by the same reference characters.

As used herein, "heavy crude oil" (sometimes abbreviated as HCO) means heavy hydrocarbons and includes heavy oil, ultra heavy oil, bitumen, sour crude oil and oil refinery heavy hydrocarbon residues. "Lighter oils," include cracked heavy crude oil distillates, e.g. cracked-distilled oil (CDO) and synthetic crude oils made by blending cracked-distilled oil and solvent extracts of cracking residue, such extracts being referred to herein as "cracking residue extracts" (CRX). "Synthetic crude oil" (SCO) means a pipeline-able lighter crude oil which is either a cracked-distilled oil or a blend of cracked-distilled oil and cracking residue extracts. The terms "cracked-distilled" and "cracking-distillation" are used herein to refer to both simultaneous and sequential cracking and distillation processes.

The present invention is a method of upgrading heavy crude oil, including high sulphur heavy crude oil, to lighter oils, such as cracked-distilled oils and synthetic crude oils. In general terms, the heavy crude oil is upgraded by simultaneous thermal cracking and venting of cracker condensables and non-condensables to a distillation apparatus, the process being done under conditions that minimize over-cracking and the formation of coke. The heavy crude oil can be desalted and/or dewatered prior to upgrading.

Referring to FIG. 1, showing one embodiment of the process in which THFA is employed, the heavy crude oil 10 is fed to a cracking vessel 12, in which the heavy crude oil is thermally cracked and, simultaneously during cracking, the volatile components 14 are vented from the cracking vessel. The simultaneously-vented volatile components 14 are distilled in a distillation column 16 so as to separate condensable volatile components 18, which comprise the cracked-distilled oil, from non-condensable volatile components 20. The distillation may be carried out simultaneously or sequentially with the thermal cracking; however, the venting of cracker condensables and non-condensables is simultaneous with cracking. The thermal cracking is carried out at atmospheric pressure or, alternatively, below atmospheric pressure, for example at a pressure in the range of about 10 Torr to atmospheric, or in the range of about 100 Torr to atmospheric. The thermal cracking is done at a temperature in the range of 400° to 450° C., alternatively in the range of 410° to 450° C., alternatively in the range of 420° to 450° C., alternatively at a temperature less than 450° C. The cracking may be performed for a time period of less than 40 minutes, alternatively less than 20 minutes, alternatively less than 15 minutes. A sweep or purge gas is not required or used in the cracking vessel.

Tetrahydrofurfuryl alcohol (THFA) 22 is added to the heavy crude oil before or during thermal cracking. THFA use has several advantages. It reduces the acidity of cracked-distilled oil and cracking residue extracts, and increases the rate of heavy crude oil cracking. It can be added to the heavy crude oil in the field as a heavy crude oil diluent to dramatically reduce heavy crude oil viscosity, thereby simplifying and reducing the cost of transport of the heavy crude oil to the upgrader. THFA can also prevent bumping during cracking-distillation due to water contamination of the heavy crude oil feedstock. THFA has the ability to dissolve asphaltenes or asphaltene cores in whole or part, thereby inhibiting their undesirable coagulation or precipitation and subsequent conversion to coke (e.g. via dimerization, oligomerization or polymerization of asphaltenes or asphaltene cores). THFA can also accelerate cracking by reducing heavy crude oil viscosity and thereby improving fluid mechanics. The THFA content of the THFA-heavy crude oil mixture may be in the range of about 10 to 20 weight %.

The THFA is vented simultaneously during the thermal cracking, with the vented volatile components. Simultaneous venting of THFA during the thermal cracking reduces its exposure to the high temperature cracking conditions, and maximizes its recyclablity for subsequent process steps. The THFA additive 22 is distillable and capable of dissolving and/or dispersing asphaltenes (whether in the heavy crude oil feedstock or in the cracking residue). The THFA is distilled from the distillation column (stream 19) and is recycled for mixing with the heavy crude oil feedstock 10.

Non-condensable volatile components 20 generated during vented thermal cracking, which are not condensable in the distillation apparatus 16, may be incinerated to recover their heat content, e.g. in a fluidized bed combustor 24. Non-condensable volatile components 20 may include, for example: (a) low molecular weight olefins, such as ethylene and propylene, which are susceptible to coke formation in pressurized, un-vented visbreakers, or susceptible to dimerization or polymerization in pipelined synthetic crude oil; (b) low molecular weight alkanes, such as methane, ethane and propane, which are susceptible to causing undesirable "deasphalting coagulation" of asphaltenes to undesirable coke; and (c) hydrogen sulphide, which can destroy THFA by converting it to its thioether equivalent under high pressure and temperature conditions.

Figure 2:
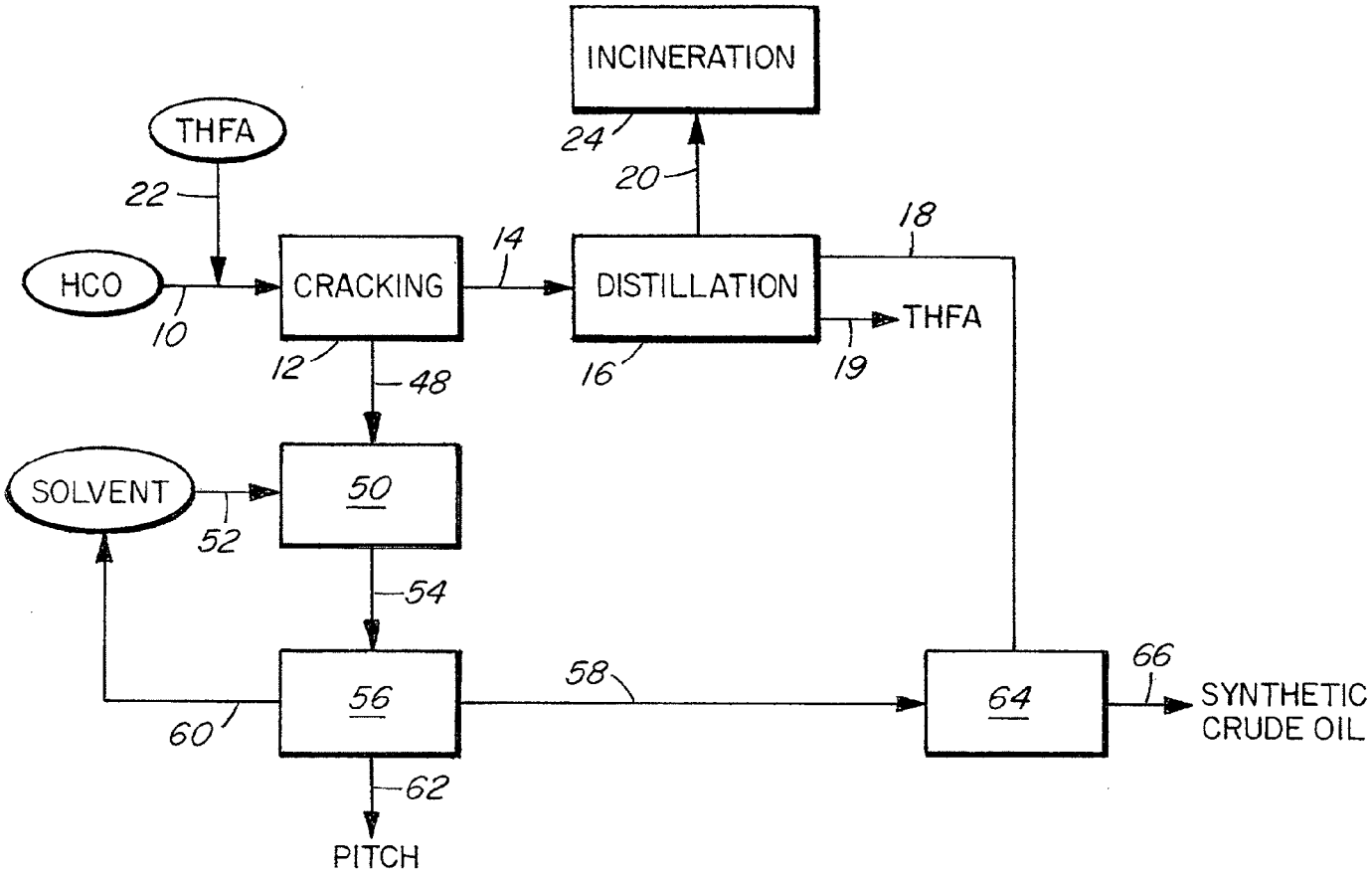
FIG. 2 is a schematic diagram of a second embodiment of the method and apparatus of the invention, in which THFA additive is used and cracked-distilled oil is blended with cracking residue extracts.

The thermal cracking produces cracking residue, and in some embodiments of the invention, the produced cracked-distilled oil 18 is blended with cracking residue extracts to produce synthetic crude oil. Referring to FIG. 2, illustrating a second embodiment, the cracking residue 48 from the thermal cracker is processed by solvent extraction 50 with a low molecular weight alkane 52 (e.g. a C5 or smaller hydrocarbon, such as n-pentane, isopentane or butane) to produce a mixture of a cracking residue extract and the alkane solvent (stream 54). The alkane can be separated from the cracking residue extract by low temperature distillation 56 to produce pure cracking residue extract 58 and alkane (stream 60) which may be recycled for further solvent extraction use. The residue from the cracking residue extract-alkane extraction is a pitch 62 rich in asphaltenes that can be incinerated, e.g. in a fluidized bed, or used in asphalt production.

Synthetic crude oil is prepared by mixing 64 the essentially THFA-free distillate, i.e. the cracked-distilled oil stream 18, with the essentially alkane-free distillation residue extract 58 to form the synthetic crude oil 66, which thus comprises a cracked-distilled oil and cracking residue extract mixture. If the synthetic crude oil 66 has an API gravity slightly below pipeline specifications it can be supplemented with a small amount (e.g. less than 2 weight %) of high API condensate (e.g. 65+API) to increase the API to meet the pipeline specifications.

Figure 3:
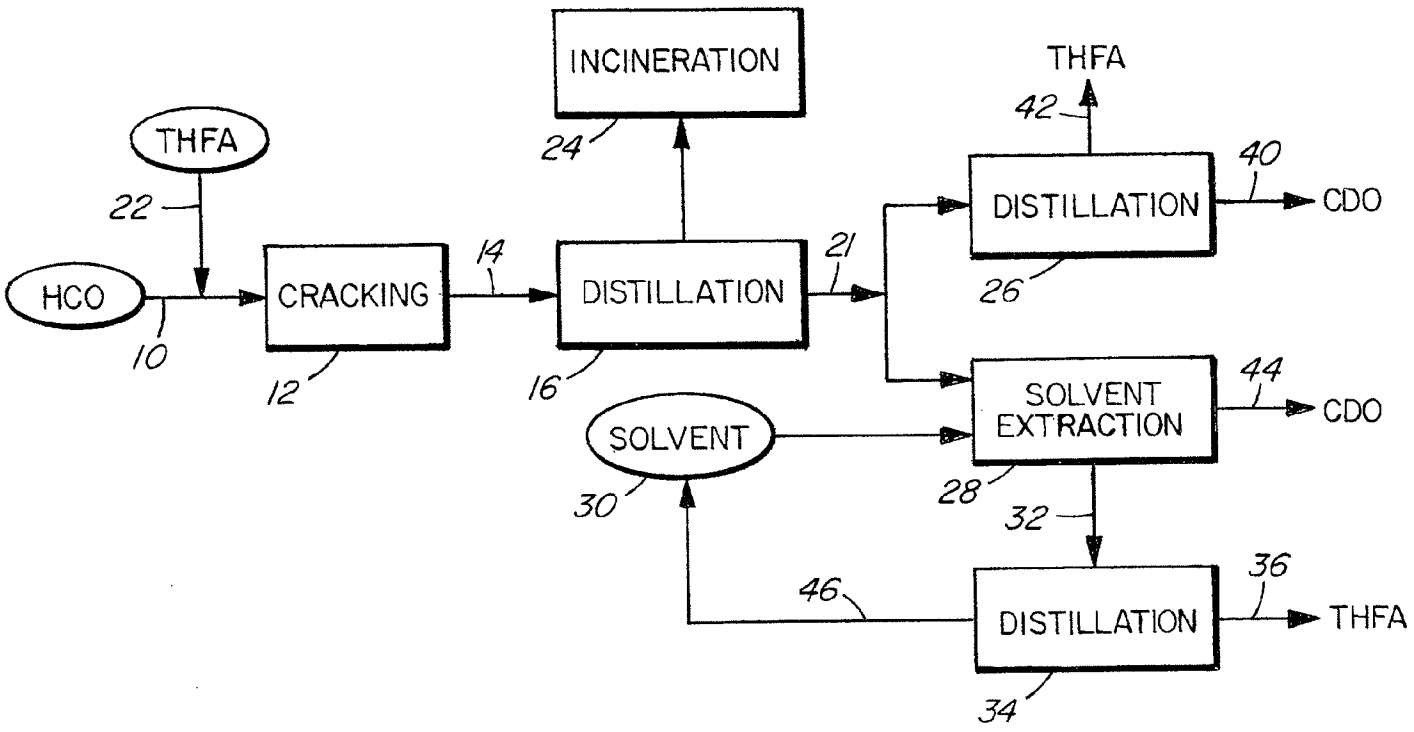
FIG. 3 is a schematic diagram of a third embodiment of the method and apparatus of the invention, in which THFA additive is used and it is subsequently separated from the condensable volatile components.

In a third embodiment of the invention, the THFA is distilled from the distillation column with the condensable volatile components, from which it is subsequently separated. Referring to FIG. 3, instead of separately distilling the THFA from the distillation column as in the FIGS. 1 and 2 embodiments, the distillation 16 is operated to produce a cracked-distilled oil and THFA mixture 21. This mixture is then, subsequently, separated into cracked-distilled oil and THFA. This may be done by distillation 26, for example in a commercial high theoretical plate distillation column. This separation produces a cracked-distilled oil stream 40 and a THFA stream 42. Additionally or alternatively, the cracked-distilled oil and THFA mixture 18 can be processed by solvent extraction 28, e.g. with water as the solvent 30, to remove the THFA additive from the cracked-distilled oil. This produces a cracked-distilled oil stream 44 and a THFA-solvent mixture stream 32. This stream 32 is then distilled to separate the solvent (stream 46) from the THFA (stream 36). In either case, the THFA stream 42 or 36 is recycled for re-use in the heavy crude oil cracking.

Figure 4:
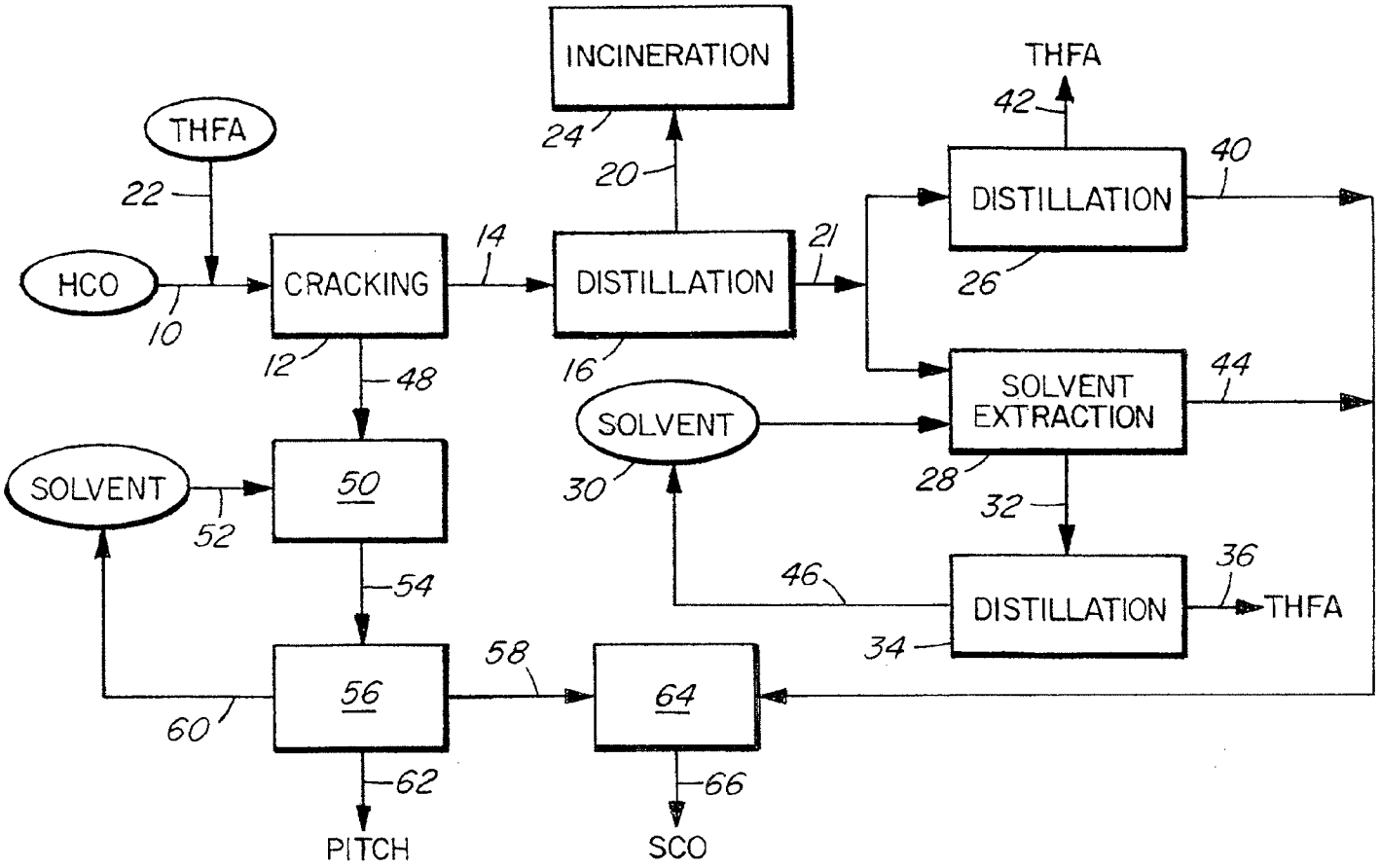
FIG. 4 is a schematic diagram of a fourth embodiment of the method and apparatus of the invention, combining features of the second and third embodiments.

FIG. 4 illustrates a fourth embodiment of the upgrading process, which includes both the sequential distillation/solvent extraction of the THFA from the mixture 21 of THFA and condensable volatiles (as in FIG. 3) and the blending of the cracked-distilled oil with the cracking residue extract (as in FIG. 2). The cracked-distilled oil (stream 40 and/or 44) and the cracking residue extract 58 are mixed 64 to form the synthetic crude oil 66.

Figure 5:
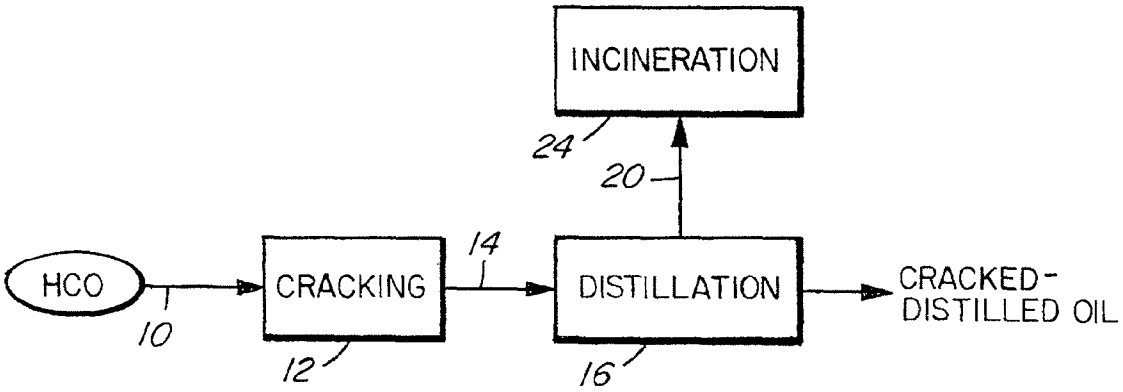
FIG. 5 is a schematic diagram of a fifth embodiment of the method and apparatus of the invention, in which THFA additive is not used.

The addition of THFA to the heavy crude oil feedstock 10 is advantageous but optional in the upgrading process of the invention, and in some embodiments the upgrading is performed without using the additive. Referring to FIG. 5, the heavy crude oil 10 is fed to the cracking vessel 12, in which it is thermally cracked and the volatile components 14 are simultaneously vented from the cracking vessel. The simultaneously-vented volatile components 14 are distilled in a distillation column 16 so as to separate the condensable volatile components 18, which comprise the cracked-distilled oil, from the non-condensable volatile components 20, which are fed to the incinerator 24.

Figure 6:
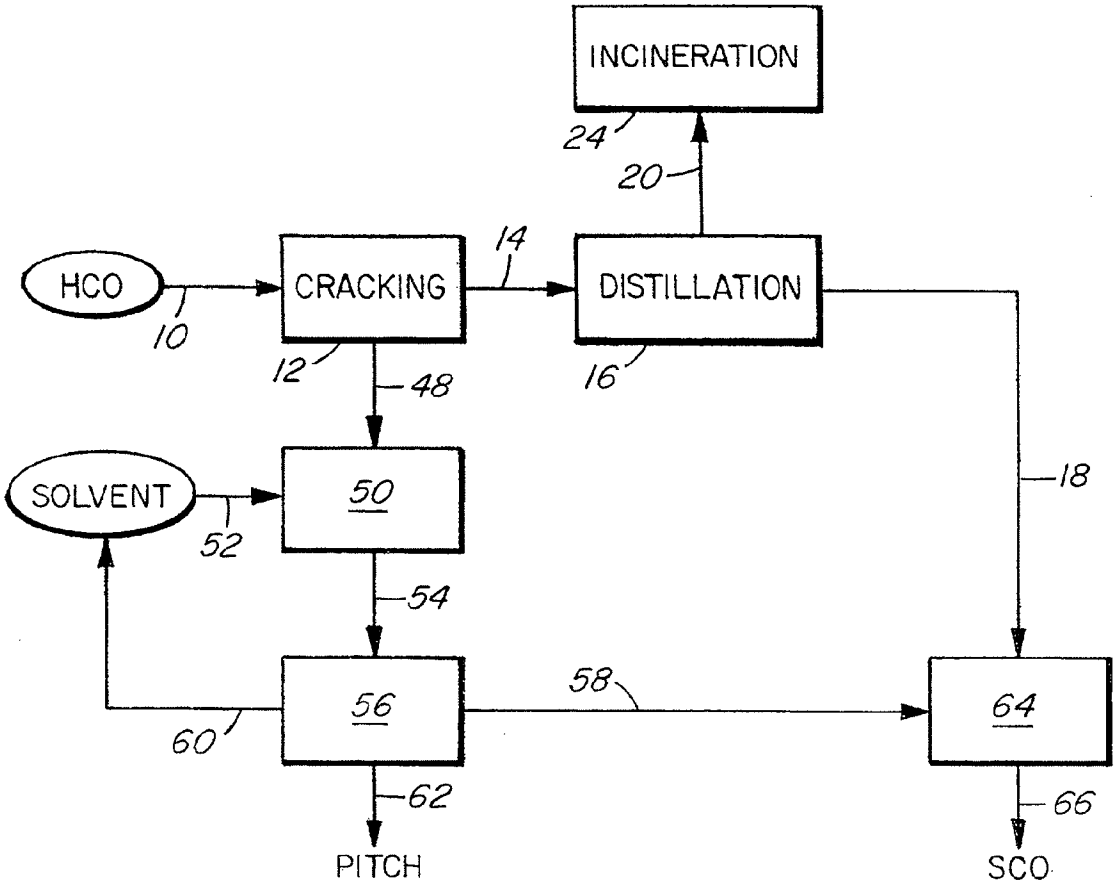
FIG. 6 is a schematic diagram of a sixth embodiment of the method and apparatus of the invention, in which THFA additive is not used and the cracked-distilled oil is blended with cracking residue extracts.

The produced cracked-distilled oil 18 may be blended with cracking residue extract. This is illustrated in FIG. 6, showing the sixth embodiment of the process, in which the cracking residue 48 from the cracking vessel is processed as described above in respect of the FIG. 2 embodiment, and the resulting cracking residue extract 58 is blended 64 with the cracked-distilled oil 18 to produce the synthetic crude oil 66.

Synthetic crude oil that comprises cracked-distilled oil, and especially synthetic crude oil that comprises cracked-distilled oil mixed with cracking residue extract, as made in accordance with invention, possesses superior properties to heavy crude oil in all of the following categories: microcarbon residue (MCR); total acid number (TAN); nickel content; vanadium content; viscosity; API gravity; yield of distillable hydrocarbons having boiling points at or below 525° C.; sulphur content; asphaltene content (e.g. insoluble in pentane, isopentane, etc.); and production of asphalt or pitch byproduct with low toluene insolubles content.

EXAMPLES

Example 1 Simultaneous Thermal Cracking and Distillation of Athabasca Bitumen with Sequential Solvent Deasphalting with and without THFA Athabasca bitumen was subjected to three cracking and solvent deasphalting treatments:

Run A: conventional visbreaking treatment;

Run B: treated according to the present invention, without THFA;

Run C: treated according to the present invention, with THFA.

Conventional visbreaking, Run A, was carried out in a pressurized, stirred stainless steel autoclave for 1050 seconds at an equivalent temperature of 410-412° C. The reaction product was cooled rapidly to room temperature and the resulting gas product was analyzed. Gas yield in weight % of the HCO feed was 13.6%. Although Run A may be distinguished from other visbreaking processes by its temperature and severity of the operation, for present purposes the severity of a process can be compared using the following equation:

$$\theta_{875^\circ F} = 60 \times \exp\left[\left(\frac{Ea \times 1.8}{1.987}\right)\left(\frac{1}{875+840} + \frac{1}{7^\circ\ F + 460}\right)\right]$$

Where: $\theta_{875^\circ F}$=Equivalent seconds at 875° F. for 1 min. operation at T ° F.

Ea=Activation energy in cal./g-mole (53,000 Cal/g-mole typical for Visbreaking)

In Runs B and C vented thermal cracking was carried out using an American Society of Testing Materials (ASTM) D86 distillation apparatus, at atmospheric pressure so that all volatile components generated during cracking could be condensed as they were formed with a water condenser or collected in a Tedlar® sampling bag for analysis. The ASTM D86 apparatus allows continuous exhausting of volatile components that are not condensed by the condenser. The condensed volatile components were not returned to the cracking vessel. The condensed volatile components formed a cracked-distilled oil.

The resulting cracking products were distilled:

at atmospheric pressure without THFA (Run B);

at atmospheric pressure with THFA (Run C); and under vacuum (Run A);

CDO's with a maximum distillate boiling point of 330° C. were formed in Runs B and A. A CDO with a maximum distillate boiling point of 343° C. was formed in Run C. The distillations of runs B and C were carried out at atmospheric pressure and a maximum distillation pot (cracker) temperature of 450° C. The following Tables 2 and 3 summarize cracker temperature and vapor temperature vs. time (minutes:seconds) for runs B and C respectively starting from the cracker temperature at which vapour was generated due to boiling of the HCO or HCO and THFA feedstock in the cracker:

TABLE 2

| Run B Elapsed Time (mm:ss) | Volatiles Temperature (° C.) | Cracker Temperature (° C.) |
|---|---|---|
| 16:20 | 210.9 | 360.5 |
| 17:00 | 219.3 | 362.2 |
| 18:00 | 221.8 | 364.9 |
| 19:00 | 222.1 | 367.6 |
| 20:00 | 223.3 | 370.0 |
| 21:00 | 225.9 | 372.1 |
| 22:00 | 224..4 | 374.4 |
| 23:00 | 225.0 | 376.5 |
| 23:25 | 227.1 | 377.5 |
| 24:00 | 243.1 | 379.3 |
| 25:00 | 261.1 | 384.0 |
| 26:00 | 274.4 | 389.8 |
| 27:00 | 279.9 | 395.6 |
| 28:00 | 287.0 | 401.4 |
| 29:00 | 290.2 | 407.3 |
| 30:00 | 289.7 | 413.5 |
| 31:00 | 291.6 | 418.5 |
| 32:00 | 302.6 | 423.5 |
| 33:00 | 307.9 | 430.0 |
| 34:00 | 316.4 | 436.3 |
| 35:00 | 322.9 | 442.3 |
| 36:00 | 328.7 | 450.0 |
| 37:00 | 288.3 | 446.6 |
| 38:00 | 236.0 | 438.8 |
| 39:00 | 193.3 | 430.2 |
| 40:00 | 167.1 | 419.7 |

TABLE 2-continued

| Run B Elapsed Time (mm:ss) | Volatiles Temperature (° C.) | Cracker Temperature (° C.) |
|---|---|---|
| 41:00 | 145.6 | 408.4 |
| 42:00 | 129.1 | 395.7 |
| 43:00 | 116.2 | 384.0 |

TABLE 3

| Run C Elapsed Time (mm:ss) | Volatiles Temperature (° C.) | Cracker Temperature (° C.) |
|---|---|---|
| 0 | 174.2 | 191.3 |
| 0:43 | 174.9 | 196.2 |
| 1:00 | 175.1 | 198.6 |
| 1:30 | 175.6 | 203.3 |
| 2:00 | 176.3 | 208.6 |
| 2:30 | 177.4 | 214.7 |
| 3:00 | 178.0 | 222.4 |
| 3:30 | 180.1 | 229.9 |
| 4:00 | 181.5 | 237.5 |
| 5:00 | 188.7 | 252.6 |
| 6:00 | 192.1 | 268.3 |
| 7:00 | 191.3 | 282.6 |
| 8:00 | 185.3 | 297.1 |
| 9:00 | 173.3 | 310.6 |
| 10:00 | 162.8 | 325.0 |
| 11:00 | 151.1 | 338.9 |
| 12:00 | 140.4 | 351.1 |
| 13:00 | 122.3 | 361.1 |
| 14:00 | 107.8 | 370.5 |
| 15:00 | 98.6 | 375.9 |
| 16:00 | 97.9 | 376.6 |
| 17:00 | 117.2 | 377.3 |
| 18:00 | 220.2 | 380.7 |
| 19:00 | 255.8 | 387.1 |
| 20:00 | 271.8 | 393.5 |
| 21:00 | 278.5 | 401.2 |
| 22:00 | 282.1 | 408.1 |
| 23:00 | 290.8 | 415.2 |
| 24:00 | 298.0 | 421.3 |
| 25:00 | 307.5 | 428.7 |
| 26:00 | 319.8 | 435.3 |
| 27:00 | 327.9 | 441.5 |
| 28:00 | 342.5 | 449.9 |
| 28:30 | 313.4 | 448.6 |
| 29:00 | 276.9 | 445.4 |
| 29:30 | 249.9 | 441.6 |
| 30:00 | 227.9 | 437.5 |
| 30:30 | 205.8 | 431.5 |
| 31:00 | 191.1 | 426.9 |
| 31:30 | 178.3 | 421.4 |
| 32:15 | 162.8 | 412.5 |
| 33:00 | 149.3 | 403.4 |
| 34:00 | 133.8 | 390.6 |

The Run A conventional CDO was distilled under vacuum to prevent additional cracking of the pressurized visbreaker product. The cracking residue from Runs A and C were extracted with an 8:1 weight ratio of isopentane to form a cracking residue extract after evaporation of the isopentane.

The cracking residue from Run B was extracted with an 8:1 weight ratio of pentane to form a cracking residue extract after evaporation of the pentane. The CDO's and cracking residue extracts were blended to form synthetic crude oil products.

Table 4 compares the relative performance of Runs A, B and C.

TABLE 4

| | Run | | |
|---|---|---|---|
| | A | B | C |
| Cracking type | un-vented | vented | vented |
| Thermal cracking time (equivalent seconds @427° C. | 1036 | 1076 | 901 |
| Maximum cracking temperature ° C. | 412 | 450 | 450 |
| SCO yield wt % | 60.8 | 81.1 | 77.5 |
| SCO yield volume % | 65.2 | 86.9 | 84.2 |
| THFA wt % in visbreaker feed | 0 | 0 | 20 |
| Non-condensable volatile component yield wt % | 13.6 | 3.8 | 3.8 |
| Asphaltene residue yield wt % | 25.6 | 15.1 | 18.7 |
| Total | 100.0 | 100.0 | 100.0 |
| Deasphalting solvent | isopentane | pentane | isopentane |
| Bitumen residue (525+° C. boiling point) conversion % | 39.7 | 64.5 | 64.9 |
| Toluene insolubles wt % of bitumen feed | 0.16 | 0.05 | 0.07 |
| Asphaltene Reduction vs. HCO feed % | 5 | 34 | 26 |
| Distillate generation rate (grams CDO to shutdown/100 equivalent seconds @427° C. | | 7.15 | 8.09 |
| API Gravity | 20.3 | 19.4 | 22.3 |
| Viscosity centistokes @20° C. | 55 | 83 | 98 |
| TAN (mg KOH/g) | 2.51 | 0.92 | 0.66 |
| Nitrogen wt % | 0.26 | — | 0.23 |
| MCR wt % | 4.37 | 3.04 | 4.21 |

The current invention (Runs B and C) shows a dramatic increase in pipeline grade SCO yield, with corresponding dramatic reductions in the yields of non-condensable volatile components and asphaltenes. This is achieved at much lower TAN content and with ultra-low toluene insolubles formation when compared to conventional visbreaking. Addition of THFA (Run C) increases speed of cracking when compared to non-THFA cracking (Run B). Gas yields for Runs B and C were identical.

The following Table 5 shows relative volatile component production and chemical composition for Runs A and B:

TABLE 5

| | Run | | Relative volatile component Production per unit bitumen feed |
|---|---|---|---|
| | A | B | Run A:Run B |
| Non-condensable volatile component yield wt % | 13.6 | 3.8 | 3.6 |
| Methane mole % | 38.6 | 17.2 | 8.1* |
| Ethane mole % | 14.09 | 12.9 | 3.9 |
| Carbon monoxide mole % | 2.95 | 1.4 | 7.5 |
| Ethylene mole % | 0.59 | 0.61 | 3.5 |
| Propane + propylene mole % | 11.25 | 23.6 | 1.7 |
| Hydrogen sulphide mole % | 13.4 | 13.3 | 3.6 |
| n-butane mole % | 3.3 | 6.8 | 1.7 |
| n-pentane mole % | 0.59 | 2.37 | 0.9 |
| hexanes mole % | 0.26 | 1.9 | 0.5 |
| heptanes mole % | 0.01 | 0.475 | 0.1 |

*(3.6 * 38.6/17.2)

Note that the ratio of relative volatile component production decreases with the increasing molecular weight of the hydrocarbon volatile components, which indicates that valuable condensable alkanes (e.g. n-pentane, hexanes, heptanes etc.) are being ruptured via cracking to less valuable products with enhanced deasphalting properties in the un-vented visbreaker (Run A).

Note also that the rupturing of un-vented alkanes increases their solvent deasphalting capability thereby negatively altering asphaltene cracking chemistry towards increased formation of alkane insolubles (asphaltenes or coke). The cracking of alkanes and alkyl sulphides to lower molecular weight alkanes and hydrogen sulphide, respectively, consumes hydrogen which increases aromaticity of the cracking liquor and further reduces its solubility in the presence of un-vented low molecular weight alkanes.

Example 2 Simultaneous Thermal Cracking and Distillation of Lloydminster Heavy Oil with and without THFA Two samples of HCO from Lloydminster, Alberta, Canada, were heated for 2 hours at 150° C. followed by atmospheric pressure cracking-distillation, Sample 1 having 10 parts by weight THFA per 90 parts by weight HCO, and Sample 2 having no THFA. Sample 1 was aerated and stirred with a magnetic Teflon®-coated stirrer bar during the heating step prior to distillation. The THFA-HCO mixture was stirred during cracking-distillation. The samples were heated until excessive foaming occurred in the distillation apparatus. Cracking-distillation was carried out using the apparatus described in ASTM method D86, allowing continuous exhausting of volatile components that are not condensed by the water-cooled condenser. The initial and final boiling points for atmospheric pressure distillate (CDO) of Sample 2 were 143° C. and 342° C., respectively. The initial and final boiling points for the atmospheric pressure distillate (CDO) of Sample 1 were 158° C. and 320° C., respectively.

It is known that THFA is able to form small amounts of organoperoxide (THFAP) under aeration, especially at elevated temperatures. Organoperoxides are able to decompose under heat to create free radicals which are believed to enhance thermal cracking of molecules such as those in HCO. It is believed that one functionality of THFA is to generate HCO free radicals conducive to enhanced thermal cracking before or during distillation when the THFA is exposed to oxygen alone or in combination with HCO. This is indicated by lower maximum boiling point of the Sample 1 distillate than of the Sample 2 distillate (i.e. 320° C. vs. 342° C.).

It will be readily apparent to persons skilled in the art that aeration may be carried out in a number of different ways, although the results may vary. For example, the THFA-HCO mixture can be aerated prior to distillation as described above, or the THFA-HCO mixture can be aerated during the distillation, or the distillate (containing THFA) can be aerated, or THFA can be aerated prior to mixing with HCO, etc.

Table 6 below compares results obtained by distillation of Samples 1 and 2:

TABLE 6

| | Sample 1 HCO + THFA | Sample 2 HCO |
|---|---|---|
| HCO input (grams)(excludes water) | 87.95[1] | 97.48 |
| THFA input (grams) | 10.05 | 0 |
| TAN (mg KOH/gram of HCO) | 1.26 | 1.26 |
| Distillate (grams) (excludes water and THFA) | 69.33 | 53.01 |
| Olefins in distillate (as micromoles hydrogen/gram distillate) | 202.7 | 235.7 |
| TAN (mg KOH/gram of distillate) | 0.15 | 0.32 |

[1]HCO input = 90.21 grams (includes water)

Therefore, the cracking-distillation of THFA-HCO mixture achieved the following results:

- 45% increase in yield of CDO by weight using THFA additive (Sample 1) vs. no additive (Sample 2).
- 53% reduction in acid content of the Sample 1 CDO (as measured by total acid number "TAN") vs. the Sample 2 CDO.

In addition, the Sample 1 CDO had the following characteristics, relative to the undistilled HCO feed:

- 14% reduction in the olefin content of the Sample 1 CDO, as measured by nuclear magnetic resonance (NMR) vs. the HCO feed.
- 88% reduction in acid content of the Sample 1 CDO, (as measured by total acid number "TAN") vs. the HCO feed.
- 44% reduction in sulphur content of the Sample 1 CDO, having THFA added to the HCO feed vs. the undistilled HCO feed (i.e. 2.1% and 3.8% sulphur by weight in Sample 1 CDO and undistilled HCO feed, respectively).

Addition of THFA to the HCO feed clearly enhanced the value of the CDO while producing a product free of inorganic ash. Such a product would be suitable for use as a fuel in, for example, gas turbines or other combustion devices producing steam, electricity, or steam plus electricity. The product may also be used as a higher value oil-refinery or upgrader synthetic crude oil feedstock.

Example 3 Simultaneous Thermal Cracking and Distillation of Lloydminster Heavy Oil with and without THFA Sample 3, having the same HCO used in Example 2, was cracked-distilled in similar fashion to Example 2 above, to determine the effect of THFA on distillate density (e.g. API gravity) and viscosity. Sample 3, consisting of a THFA-HCO mixture having 10 parts by weight THFA per 90 parts by weight HCO, was heated for 2 hours at 150° C. with aeration and stirring, followed by atmospheric pressure distillation. The results are as follows:

- 201% increase in API gravity of Sample 3 CDO vs. undistilled HCO feed (i.e. API gravity of 9.3 for undistilled HCO feed vs. API gravity of 27.0 for Sample 3).
- 99.9% reduction in viscosity of Sample 3 CDO vs. undistilled HCO feed (i.e. viscosity of 93 cp for Sample 3 vs. 82200 cp for undistilled HCO feed).

These results clearly show the value of adding high boiling point THFA alcohol-ether to HCO, especially high-sulphur HCO, (i.e. sour heavy crude oil).

Example 4 Simultaneous Thermal Cracking and Distillation of Athabasca Bitumen with and without THFA Two samples (Samples 4 and 5) of HCO (bitumen from Athabasca, Alberta, Canada), were cracked-distilled via atmospheric pressure distillation in similar fashion to Example 2 above followed by vacuum distillation of the atmospheric distillation residue to create additional CDO (part 2) (i.e. 760 mm mercury pressure followed by 0.67 mm mercury pressure). The uncondensed gases from the atmospheric pressure distillation were collected in a Tedlar® bag and the condensed distilled volatiles were collected to form a CDO (part 1). Samples 4 and 5 were not subjected to 2-hour aeration, stirring or heating at 150° C. Sample 4 had 10 parts by weight THFA per 90 parts by weight HCO, and Sample 5 had no THFA. Cracking-distillations were carried out using the apparatus described in ASTM method D86. Samples 4 and 5 were stirred with a magnetic Teflon®-coated stirrer bar, during the atmospheric pressure cracking-distillation. Atmospheric pressure distillation time for Sample 4 was 528 seconds (time from start of producing distillate to the end of producing distillate). The initial and final boiling points for atmospheric pressure distillate of Sample 5 were 296° C. and 374° C., respectively. The initial and final boiling points for atmospheric pressure distillate (CDO) of Sample 4 were 176° C. and 380° C., respectively.

The HCO feed had the following properties: viscosity 350,000 cP at 20° C., olefins 0.334, TAN=3.22, API ~8.5, density ~1.017, sulphur 4.98 wt %.

The addition of THFA to the HCO achieved the following results:

- 10.1% increase in yield of atmospheric pressure distillate (CDO); 47.7% vs. 42.9 wt % of bitumen feed using the THFA additive (Sample 4) vs. no additive (Sample 5);
- 13.6% reduction in the yield of atmospheric pressure non-distillable residue (47.8% vs. 54.3%) using the THFA additive (Sample 4) vs. no additive (Sample 5);
- 4.6% increase in the combined yield of atmospheric pressure distillate (CDO part 1) and vacuum distillate (CDO part 2) at 61.4 wt % (using the THFA additive (Sample 4)) vs. vs. 58.3 wt % (no additive (Sample 5));
- 37.6% reduction in acid content of the atmospheric pressure distillate (TAN 0.90 vs. 1.36) using the THFA additive (Sample 4) vs. no additive (Sample 5);
- 46.0% reduction in olefins content (millimoles H/gram 0.830 vs. 1.537) of the atmospheric pressure distillate using the THFA additive (Sample 4) vs. no additive (Sample 5); and
- 37.6% reduction in viscosity at 20° C. of the atmospheric pressure distillate (cp 11.3 vs. 18.1) using the THEA additive (Sample 4) vs. no additive (Sample 5).

In addition, the Sample 4 CDO had the following characteristics, relative to the undistilled HCO feed:

- 177% increase in API gravity of the atmospheric pressure distillate using the THFA additive (Sample 4) vs. the undistilled HCO feed (API 23.6 vs. about 8.5);
- 34.5% reduction in sulphur content of the atmospheric pressure distillate using the THFA additive (Sample 4) vs. the undistilled HCO feed (sulphur wt % 3.26 vs. 4.98);
- 72.0% reduction in acid content of the atmospheric pressure distillate using the THFA additive (Sample 4) vs. the undistilled HCO feed (TAN 0.90 vs. 3.22); and
- >99.9% reduction in viscosity of the atmospheric pressure distillate using the THFA additive (Sample 4) vs. the undistilled HCO feed (cp 11.3 vs. 350,000).

THFA can be removed from the distillate, as from CDO, by distillation, since its boiling point of 178° C. is lower than that of the majority of CDO components. With respect to the distillate of Sample 4, it is estimated that less than about 5% of the distillate boils below the THFA boiling point, and that about 95% of the distillate boils above the THFA boiling point. Therefore it is possible to obtain high THFA recovery by distillation alone. Note that the vacuum distillation residues from this example could have been extracted with an alkane solvent to produce cracking residue extracts, but this operation is optional.

Example 5 THFA Recyclability

In Run D the same HCO bitumen as in Example 1 above (Athabasca bitumen) was cracked-distilled via atmospheric pressure distillation (760 mm mercury pressure) in similar fashion to Example 1 above, followed by n-pentane solvent extraction of the atmospheric pressure distillation residue. Run D had 10 parts by weight THFA per 90 parts by weight HCO. Distillation was carried out using the apparatus described in ASTM method D86. The Run D sample was stirred with a magnetic Teflon®-coated stirrer bar, during the atmospheric distillation. Atmospheric pressure distillation time was 37.75 minutes (time from start of producing distillate to the end of producing distillate). The minimum and maximum boiling points for atmospheric pressure distillate (CDO) were 174° C. and 314.7° C., respectively. Maximum distillation pot (cracker) temperature was 450° C.

The atmospheric pressure distillate containing CDO-THFA was solvent extracted with water at a water: CDO-THFA mass ratio of 1:1, in three sequential water extractions, (i.e. water phase removal after each extraction prior to extraction with a fresh water phase) to strip THFA from the CDO-THFA mixture. 99.5% recovery of THFA was achieved, demonstrating recyclability of THFA for further use.

The cracking residue was then refluxed, and the resulting reflux mixture filtered. Specifically, the cracking residue was refluxed for 60 minutes with n-pentane in an 8:1 mass ratio of n-pentane: cracking residue. The resulting reflux mixture was poured into a Whatman® Grade 42 (2.5 μm) ashless filter paper followed by refluxing of the resulting CR-n-pentane filtrate to drip 2-4 drops per second of n-pentane reflux distillate onto the filter contents. Refluxing was continued until the filtrate was clear. The filtrate was then evaporated at 100° C. for 4 hours to remove all traces of n-pentane from the CR-n-pentane filtrate (i.e. pentane-free cracking residue extract) from a Whatman® Grade 42 (2.5 μm) ashless filter paper, CDO and cracking residue extract were blended to form a synthetic crude oil with the following results compared to the bitumen feedstock:

TABLE 7

| Variable | HCO (bitumen) | Run D SCO | % Improvement |
|---|---|---|---|
| (MCR) weight % | 14.6 | 2.2 | 85 |
| TAN | 3.22 | 0.76 | 76 |
| Nickel ppm | 79 | 7 | 91 |
| Vanadium ppm | 217 | 9 | 96 |
| Chlorine ppm | 1443 | 102 | 93 |
| Viscosity cps@20° C. | 350,000 | 102 | 99.97 |
| API gravity | 10.6 | 18.2 | 72 |
| Sulphur weight % | 4.98 | 3.74 | 25 |
| Nitrogen weight % | 0.395 | 0.21 | 46 |
| Simulated Distillation yield volume % | | | Difference in % between HCO and SCO |
| C5-180° C. (naphtha) | 0.0 | 4.3 | 4.3 |
| 180-343° C. (distillate) | 11.0 | 27.3 | 16.3 |
| 343-525° C. (gas oil) | 31.0 | 44.1 | 13.1 |
| +525° C. (residue) | 58.0 | 24.3 | −33.7 |

MCR = microcarbon residue via ASTM method D4530

The volumetric yield of SCO was 87.7% of the HCO feed (i.e. 100,000 barrels of HCO would yield 87,700 barrels of SCO). SCO yield on a weight basis was 83.0% of HCO.

The quality difference between the synthetic crude oil and the bitumen feedstock has the following significance:

a) Microcarbon Residue (MCR)—The asphaltene components of HCOs such as bitumens are susceptible to coke formation in refinery operations. Coke formation in oil refinery operations not designed to handle it can cause severe fouling problems resulting in extra maintenance and downtime. Therefore the SCO produced by the present invention is more valuable than its bitumen HCO feedstock based on its much lower MCR content.

b) TAN—The total acid number of a refinery crude reflects its naphthenic acid content. Naphthenic acid is very corrosive in oil refinery atmospheric distillation columns. High TAN crudes sell at a sizeable discount to low TAN crudes. Therefore the SCO produced by the present invention is more valuable than its bitumen HCO feedstock based on its much lower TAN content.

c) Nickel—Nickel contamination in oil refineries can come from 2 sources: corrosion of stainless steel (e.g. via hydrogen chloride or naphthenic acids) or nickel organometallic compounds (e.g. porphyrins) in the asphaltene portion of bitumen. Nickel, a hydrogen scavenger, causes catalyst fouling via coke formation due to dehydrogenation of alkanes to olefins in catalytic crackers. Therefore the SCO produced by the present invention is more valuable than its bitumen HCO feedstock based on its much lower nickel content.

d) Vanadium—Vanadium contamination in oil refineries can come from vanadium organometallic compounds (e.g. porphyrins) in the asphaltene portion of bitumen. Vanadium destroys catalytic cracker catalysts by altering their crystal structure to non-catalytic forms. Therefore the SCO produced by the present invention is more valuable than its bitumen HCO feedstock based on its much lower vanadium content.

e) Chlorine—Inorganic or organic chlorine converts to hydrogen chloride in oil refinery hydrotreaters or hydrocrackers. Although, desalters can remove inorganic chloride, they have no impact on organic chlorides. The top sections of oil refinery atmospheric distillation columns are very prone to hydrogen chloride corrosion. Therefore the SCO produced by the present invention is more valuable than its bitumen HCO feedstock based on its much lower chlorine content.

f) Viscosity—pipeline-able SCO typical requires a viscosity below 350 cp (or centistokes) at 20° C. The SCO produced by the present invention easily meets the pipeline specification. Bitumen does not.

g) API gravity—Only 2-3 wt % of 57 API condensate is required to achieve a typical 19 API pipeline specification for the SCO, as compared to the 30+ wt % required for bitumen feedstock (a ten fold reduction in the requirement for the condensate).

h) Sulphur—Lower sulphur in HCO or SCO results in lower hydrogen requirements and thus lower hydrotreating costs for oil refineries. The SCO produced by the present invention is more valuable than its bitumen HCO feedstock based on its lower sulphur content.

i) Higher simulated distillation yield of distillable liquid hydrocarbons with a boiling point of 525° Celsius or less (i.e. less residue) content in HCO or SCO results in more oil refinery distillable product. Therefore, the SCO and CDO produced by the present invention is more valuable than its bitumen HCO feedstock based on the lower content of residues having boiling points over 525° Celsius (i.e. gas oil residue).

Example 6 Effect of THFA on HCO Feed Viscosity

The Athabasca bitumen used in Example 1 above was treated with THFA to determine the value of THFA as an HCO viscosity reducer for field application ahead of the upgrading techniques of the present invention. The following results were produced at 80° C. (Table 8):

TABLE 8

| THFA wt % HCO-THFA blend | Viscosity in centistokes |
|---|---|
| 5 | 336 |
| 10 | 191 |
| 20 | 92 |

Note that the viscosity of this HCO at room temperature in centistokes is about 350,000. THFA clearly has a major desirable impact on HCO viscosity even at a moderate dose.

Example 7 Characteristics of CDRX Residue as Asphalt or Pitch Feedstocks

Although cracking residue extract residues ("pitches") can be used as fuels (e.g. heat of combustion of about 38,000 kilojoules/gram), they also meet asphalt requirements. The Kirk Othmer Encyclopedia of Chemical Technology, Fourth Edition, Volume 3, page 706 indicates that "Asphalt is defined by ASTM as a dark brown to black cementitious material in which the predominating constituents are bitumens that occur in nature or are obtained in petroleum processing." It shows that asphalt typically contains the following components in weight %: oxygen≤2, nitrogen≤2, and sulphur≤7. The cracking residue extract residues from Runs D and C, which used 10 wt % and 20 wt % doses of THFA, respectively, had the following components in weight %: nitrogen 1.42-1.47, and sulphur 7. Furthermore, these cracking residue extracts had low toluene insolubles of 0.2-0.6%, which means that at their melting point of about 190° C. they can be easily handled as liquids without undesirable fouling due to solids settling (toluene insolubles).

Distillation units with multiple theoretical plates (e.g. packed commercial hydrocarbon distillation columns typical in oil refineries) can easily separate THFA from the distillate in one distillation, which could eliminate the need for extraction (e.g. water extraction) of the CDO distillate prior to mixing with cracking residue extract to form an SCO. This was not shown in the above examples, which used a one theoretical plate glass laboratory distillation apparatus. However, it is not always necessary to remove all of the THFA from the CDO.

It is believed that another functionality of THFA is to reduce heavy crude oil viscosity during distillation, resulting in better fluid mechanics necessary for accelerated cracking to distillable products. An additional functionality of THFA is to emulsify water in the bitumen feed to prevent it from bumping during distillation of the CDO. It is expected that distillation feedstock having THFA content that is even higher than the 20 wt % specifically discussed herein would result in similar enhancements in CDO quality including yield, speed of CDO generation, sulphur content, olefin content, etc. Quantitatively the results are expected to be sensitive to the THFA dose. In addition, when optimizing the process for particular applications, (i.e. depending on the type or quality of HCO feedstock, the type or quality of distillate desired, financial considerations, energy efficiency considerations, etc.), the parameters of the invention, including the dose of THFA, will be adjusted. The invention is not limited to any particular THFA dose.

It is important to note that the distillates (cracked-distilled oils) produced from Samples 1, 3 and 4 above are free of heavy metals. Therefore they can be further processed (with or without the THFA contained therein) to reduce sulphur content and to further increase API gravity, since they will not foul hydrotreater catalysts. The Example 4 synthetic crude oil has an extremely low metals and MCR content. It is therefore much less likely to foul refinery hydrotreater or catalytic cracker catalysts than an unprocessed heavy crude oil, such as bitumen.

In the Examples described above, the THFA and HCO were mixed and then added to the cracking vessel together. However, the invention need not necessarily be carried out in this manner. It is also possible to add the THFA and HCO to the cracking vessel separately. For example, by pumping THFA and HCO separately into the cracking vessel.

It is believed that addition of THFA to the HCO prevents coke formation while achieving a high yield of cracked-distilled oil. This is believed to be attributed to the ability of THFA to dissolve and/or emulsify cracked and uncracked HCO asphaltenes (coke precursors) and to the fact that venting of volatile components prevents olefin enhanced asphaltene polymerization to coke. Venting of hydrogen sulfide is believed to prevent THFA degradation to thioethers.

As will be apparent to those skilled in the art in the light of the foregoing disclosures, many alterations and modifications are possible in the practice of this invention without departing from the scope thereof. Accordingly, the scope of the invention is to be construed in accordance with the following claims.

The invention claimed is:

1. A method of upgrading a heavy crude oil, comprising:

(a) thermally cracking the heavy crude oil in a cracking vessel in the absence of a sweep gas, wherein the thermal cracking is conducted at a temperature less than or equal to 450° C., to convert a portion of the heavy crude oil to volatile components while simultaneously venting the volatile components from the cracking vessel;

(b) mixing tetrahydrofurfuryl alcohol (THFA) with the heavy crude oil prior to or during the thermal cracking;

(c) venting the THFA from the cracking vessel simultaneously with the thermal cracking, and separating the THFA from the condensable volatile components;

(d) separating the vented volatile components into condensable volatile components and non-condensable volatile components; and (e) collecting the condensable volatile components, said components comprising cracked-distilled oil.

2. A method according to claim 1, wherein the separation of the THFA from the condensable volatile components is by distillation.

3. A method according to claim 1, wherein the separation of the THFA from the condensable volatile components is by solvent extraction.

4. A method according to claim 1, wherein the vented volatile components comprise both cracked and uncracked components.

5. A method according to claim 1, wherein the vented volatile components comprise hydrogen sulphide, olefins or alkanes.

6. A method according to claim 5, wherein the olefins comprise ethylene or propylene.

7. A method according to claim 5, wherein the alkanes comprise methane, ethane or propane.

8. A method according to claim 1, wherein the thermal cracking is carried out at atmospheric pressure.

9. A method according to claim 1, wherein the thermal cracking is carried out below atmospheric pressure.

10. A method according to claim 9, wherein the thermal cracking is carried out at a pressure greater than 10 Torr.

11. A method according to claim 9, wherein the thermal cracking is carried out at a pressure greater than 100 Torr.

12. A method according to claim 1, wherein the THFA content of the THFA-heavy crude oil mixture is in the range of 10 to 20 wt. %.

13. A method according to claim 1, wherein the thermal cracking is conducted at a temperature greater than 412° C.

14. A method according to claim 1, wherein all or a portion of the thermal cracking is conducted at a temperature in the range of 400° to 450° C.

15. A method according to claim 1, wherein all or a portion of the thermal cracking is conducted at a temperature in the range of 410° to 450° C.

16. A method according to claim 1, wherein all or a portion of the thermal cracking is conducted at a temperature in the range of 420° to 450° C.

17. A method according to claim 1, wherein the thermal cracking is conducted for time period of less than 40 minutes.

18. A method according to claim 1, wherein the thermal cracking is performed for a period of less than 20 minutes.

19. A method according to claim 1, wherein the thermal cracking is performed for a time period of less than 15 minutes.

20. A method according to claim 1, wherein the heavy crude oil comprises one of heavy oil, bitumen, sour crude oil and oil refinery heavy hydrocarbon residues.

21. A method according to claim 1, further comprising de-salting the heavy crude oil prior to step (a).

22. A method of upgrading a heavy crude oil, comprising:

(a) thermally cracking the heavy crude oil in a cracking vessel in the absence of a sweep gas, wherein the thermal cracking is conducted at a temperature less than or equal to 450° C., to convert a portion of the heavy crude oil to volatile components while simultaneously venting the volatile components from the cracking vessel;

(b) removing a cracking residue from the cracking vessel, mixing a solvent with the cracking residue to produce a cracking residue extract and solvent mixture, and separating the cracking residue extract from the mixture;

(c) separating the vented volatile components into condensable volatile components and non-condensable volatile components; and (d) collecting the condensable volatile components, said components comprising cracked-distilled oil.

23. A method according to claim 22, further comprising mixing the separated cracking residue extract with the cracked-distilled oil to produce a synthetic crude oil.

24. A method according to claim 22, further comprising recycling the separated solvent for further solvent extraction or deasphalting.

25. A method according to claim 22, wherein the solvent is a low molecular weight alkane.

26. A method according to claim 25, wherein the alkane is one of heptane, pentane and isopentane.

27. A method according to claim 23, wherein the synthetic crude oil has an API gravity or 19 or higher.

28. The method of claim 23, wherein the synthetic crude oil has a viscosity of 350 centipoises or less.

29. A method according to claim 23, wherein the synthetic crude oil is pipeline-able.

* * * * *